US005435459A

United States Patent [19]

Huck et al.

[11] Patent Number: 5,435,459

[45] Date of Patent: Jul. 25, 1995

[54] CONTAINER AND METHOD FOR DISPENSING SEALED ARTICLES

[76] Inventors: Mark M. Huck, 3422 Porter St. NW., Washington, D.C. 20016; Irene E. Barbieri, 3073 S. Abingdon St., Arlington, Va. 22206

[21] Appl. No.: 189,493

[22] Filed: Jan. 31, 1994

[51] Int. Cl.[6] ..... B65H 5/28

[52] U.S. Cl. ..... 221/70; 221/89; 206/440

[58] Field of Search ..... 221/25, 70, 89, 90, 221/268, 47, 48; 206/804, 828, 438, 440

[56] References Cited

U.S. PATENT DOCUMENTS

| | | | |
|---|---|---|---|
| 2,409,362 | 10/1946 | Kleinmann | 221/70 |
| 3,652,006 | 3/1972 | Trewella | 229/55 |
| 3,674,176 | 7/1972 | Sagi | 221/70 |
| 4,767,002 | 8/1988 | Malcolm | 206/328 |
| 4,913,311 | 4/1990 | Garcia | 221/25 |
| 5,007,540 | 4/1991 | Beasley et al. | 206/581 |

OTHER PUBLICATIONS

Model Bandage dispenser, manufactured by Cederroths of Sweden, Salvekvick, Refill 6444.

*Primary Examiner*—Kenneth Noland
*Attorney, Agent, or Firm*—Corinne R. Gorski

[57] ABSTRACT

A dispenser, containing sealed or wrapped articles, which dispenses and simultaneously unseals or unwraps the articles as the user pulls a pull-tab on one face of the article's wrapper while an elongated tab connects the wrapper's other face to the dispenser's surface. The dispenser, therefore, is capable of delivering and unwrapping an article to the user in a convenient, facile yet economical manner as the user pulls the article from the dispenser.

8 Claims, 3 Drawing Sheets

CONTAINER AND METHOD FOR DISPENSING SEALED ARTICLES

BACKGROUND OF THE INVENTION

1. Field of the Invention

This invention relates to article dispensers, particularly to such dispensers designed to dispense by stripping off surface adhered articles.

2. Description of Prior Art

Commonly, dispensers are designed to deliver individually wrapped or unwrapped articles to the user. Such dispensers have been designed and used in the following ways: by consumers to organize and dispense personal items, such as medications; by businesses to deliver products to customers; and by manufacturers to contain and dispense materials needed in the manufacturing process. No dispenser has been invented, however, that can unwrap an individual article in the process of dispensing the article—thereby adding immensely to the user's convenience in using the article dispensed.

In the case of wrapped articles, inventors have created several types of dispensers. For example, U.S. Pat. No. 4,767,002 to Malcolm (1988) describes a packet dispenser. Oldorf's invention, however, does not provide for unwrapping the article but instead merely dispenses it. Also, U.S. Pat. No. 5,007,540 to Beasley and Dinand (1991) describes multiple dispensers; again, however, the articles are not unwrapped as part of the dispensing process.

The prior art does not show a wrapper that works in conjunction with a dispenser to unwrap the article as it is dispensed. While U.S. Pat. No. 3,652,006 to Trewella (1972) discloses a wrapper that can be easily peeled apart by the user, it does not describe a wrapper, mechanism or method whereby a wrapped article is removed from its wrapping while being dispensed.

Neither the dispensers or wrappers described above nor any other prior art describe the release of an individual article from its individual wrapper as the user pulls the wrapped article from the dispenser; nor do the dispensers or prior art show a wrapper that is attached to a dispenser in such a manner that the wrapped item is ejected from the wrapper as the user removes the article from the dispenser. The prior art, then, does not offer a dispenser which economically enhances the speed and ease with which a sealed article is delivered to the user—attributes which would facilitate and/or encourage the use of the article.

Two examples are illustrative:

First, convenient and easy access to clean medical products in a doctor's office or emergency room frequently is hampered by current methods and designs for storing and dispensing products such as sutures, bandages, and other wrapped articles. Currently, most sutures and bandages are packaged in boxes. The user must search for the box and then for the individual item before even opening the item's sterile wrapper. The boxes are generally stored in drawers, cabinets or shelves. For example, in a medical emergency, the need for fast, efficient dispensing of articles can be critical to positive outcomes of treatment. The current invention obviates all these inconveniences and inefficiencies. Medical workers would find greater access to and improved ease-of-use for various wrapped products through use of the dispenser described by the present invention.

Second, increased ease and more frequent use of certain articles such as condoms by users could reap substantial social benefits if a dispenser is available to unwrap and dispense the article. For example, the federal government now openly promotes the use of condoms to avert the spread of the AIDS virus and other sexually transmitted diseases. However, as currently packaged and dispensed, condoms are inconvenient and difficult to use. People are likely to store the condoms in purses, wallets, bathroom cabinets, under the bed, and in many other inconvenient places. This discourages use at a time when the condom is actually needed. If the condom is not readily accessible, the likelihood of its use diminishes. More specifically, male condoms are often packaged in individual wrappers which are joined together using perforations between the wrappers. The user must therefore undertake, usually in a poorly-lit (night-time) environment, the following steps to use the condom: 1) locate the condoms, 2) separate a wrapped condom from the other wrapped condoms, 3) tear open a wrapped condom, and 4) determine how to position the condom so that it unrolls properly. Each of these steps, inconvenient and frustrating to the user, is remedied by the present Huck/Barbieri invention.

All dispensers heretofore known suffer from the following disadvantages:

(a) Once dispensed, the wrapped articles must still be unwrapped by the user, adding frustration or error if time is of the essence to the user, a problem compounded if multiple dispensings are necessary in a short period of time. Moreover, if the user is wearing latex gloves, the difficulty is further aggravated.

(b) The appropriate positioning of the article must be determined by the user, perhaps in a hurried or dimly lit environment.

SUMMARY OF THE INVENTION

The present invention is uniquely designed to overcome the deficiencies of the prior art by organizing and dispensing individual articles conveniently, quickly, safely, and economically. Articles that the dispenser is well suited to dispense include bandages, sutures and condoms, electronic or other small parts—where cleanliness, convenience and safety are important considerations. The user may also easily and flexibly locate, mount, color-code and label the dispenser of the present invention, adding to the ease and convenience of dispensing the articles.

For example, the present invention permits sterile sutures or gauze bandages to be dispensed free from their wrappers, thereby allowing quicker use of the items in emergency situations. Moreover, the dispensers for these items can be easily mounted on a wall or the underside of a cabinet, improving accessibility to the items. In a hospital emergency room, the convenience of many such properly marked dispensers would be invaluable.

Accordingly, some objects and advantages of the present invention are:

(a) The invention can be installed in a convenient location and in any position;

(b) The invention can dispense articles individually;

(c) The invention can dispense articles such that they become unwrapped as they are dispensed;

(d) The invention can dispense articles such that they are presented to the user in a known position, making use of the article easier; and (e) In the case of condoms, the resulting ease-of-use may encourage the use of condoms and, therefore, may reduce the spread of sexually-transmitted diseases.

Other features and advantages of the present invention will become apparent from the following description of the invention which refers to the accompanying drawings.

DETAILED DESCRIPTION OF THE PREFERRED EMBODIMENTS

Figure 1:
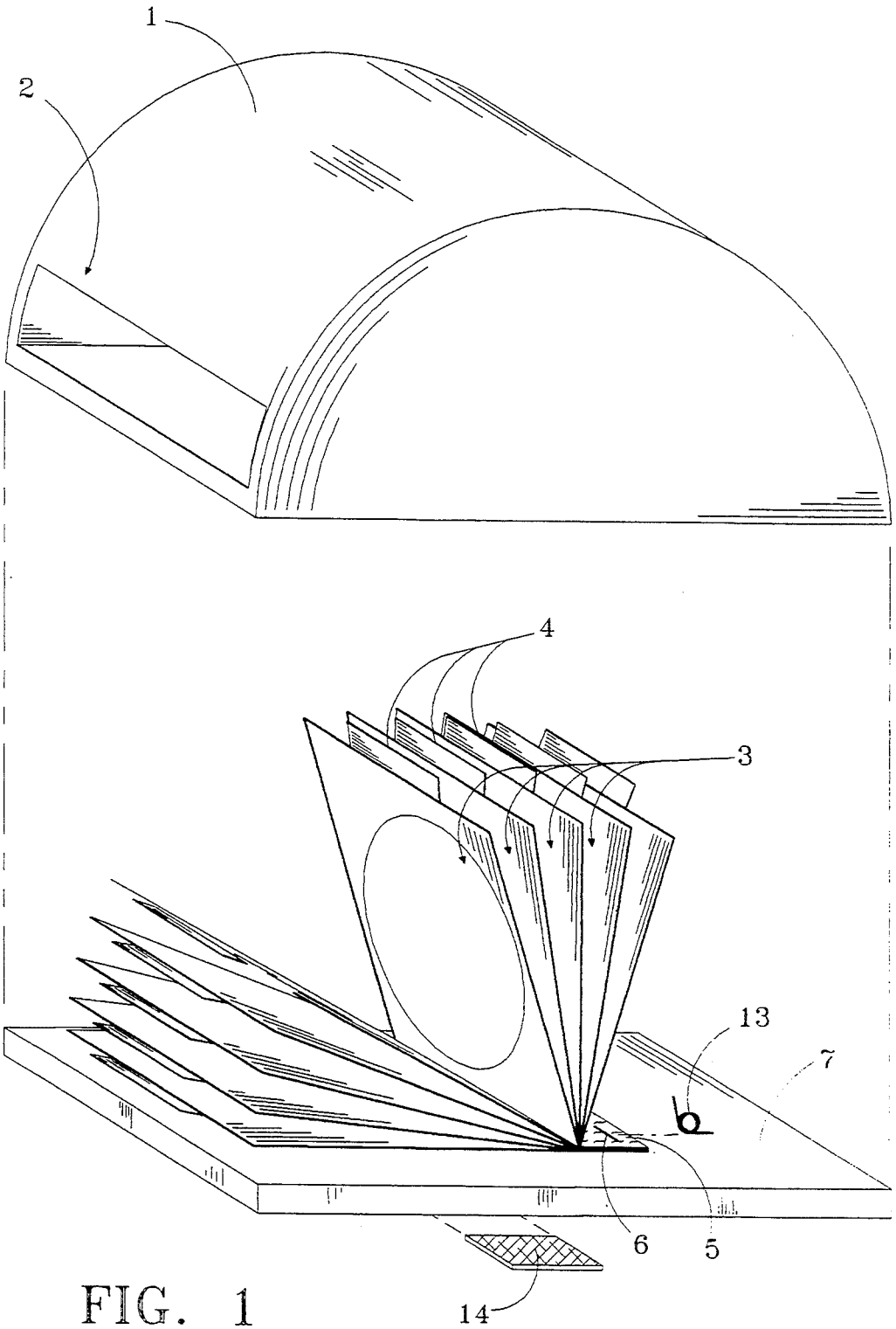
FIG. 1 is a perspective view of one embodiment of the invention shown as semi-circular-shaped container.

An embodiment of the invention is illustrated in FIG. 1. Inside a dispenser casing 1 is a surface 7 onto which elongated tabs 5 of the wrapped articles 3 are attached using a fastener 6. Pull-tabs 4 on the wrapped articles 3 are visible to the user through an opening 2 in the dispenser 1. A coiled spring 13 presses the articles toward the opening 2. The dispenser may be mounted to a wall or other surface using the mounting bracket or adhesive surface 14.

Figure 2:
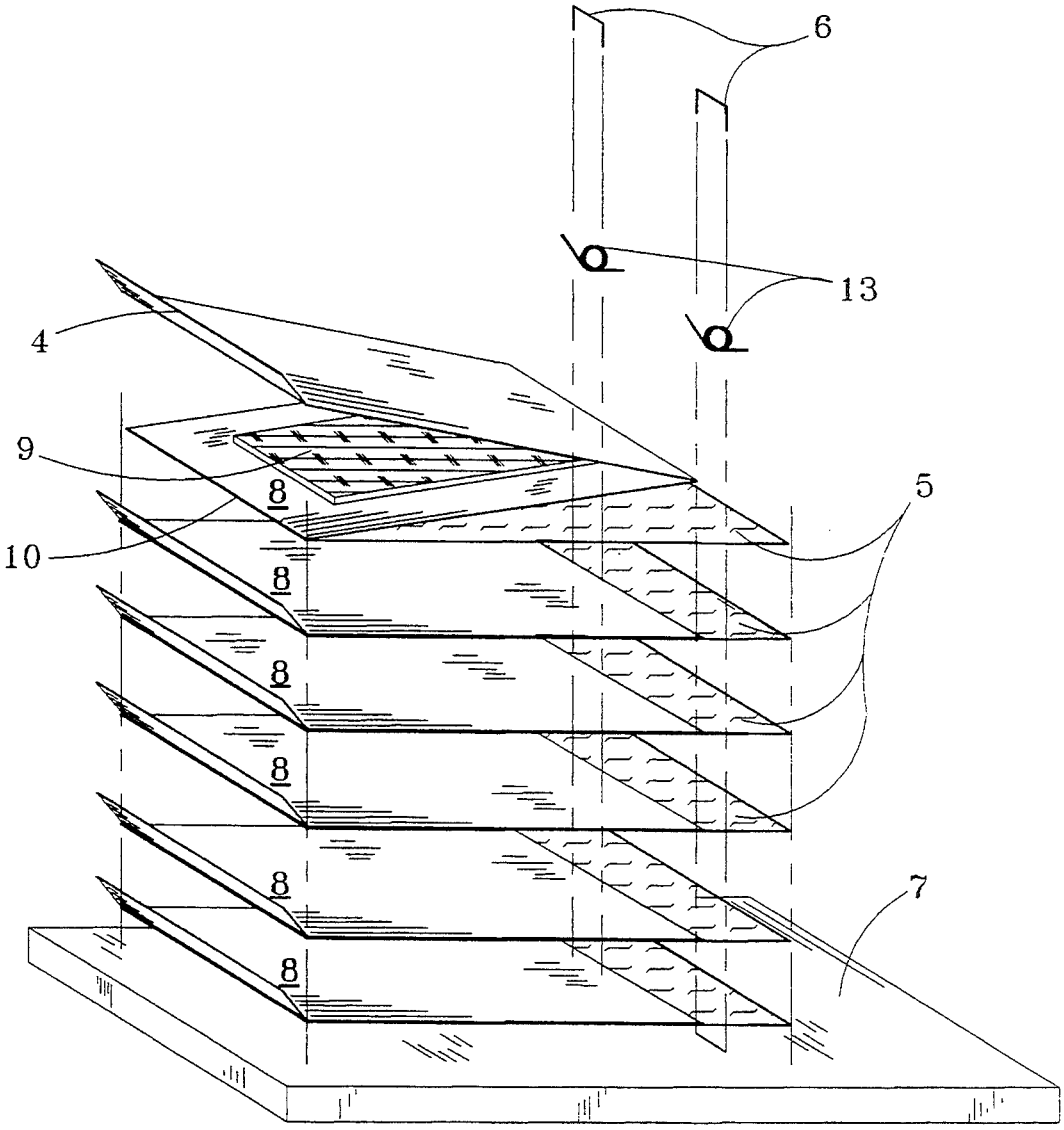
FIG. 2 illustrates how the wrappers are fastened to the dispenser.
Figure 3A:
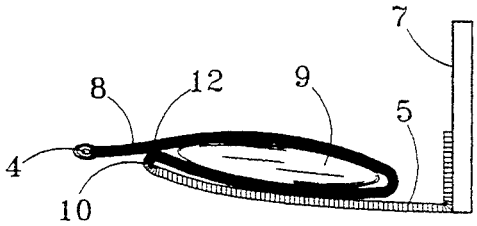
FIG. 3A–3E illustrates the method of removing articles from the dispenser in which the wrapper is opened in the process.
Figure 3B:
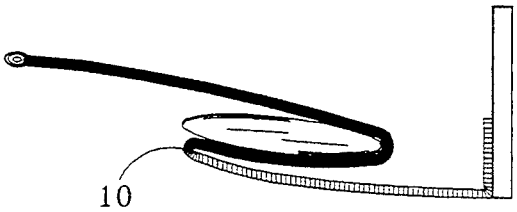
Figure 3C:
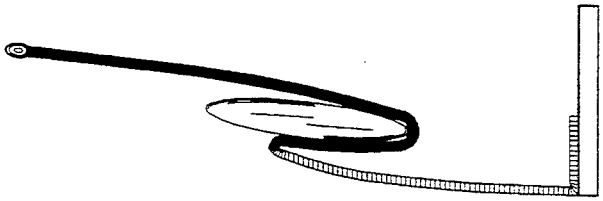
Figure 3D:
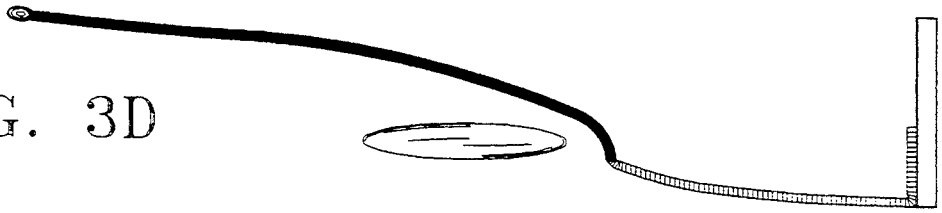
Figure 3E:
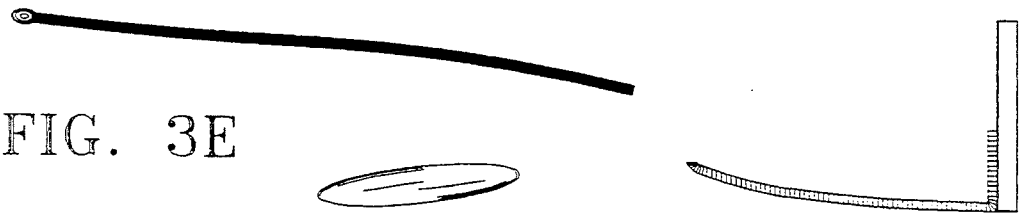

FIG. 2 shows a detail of how a wrapper 8 is sealed and then attached to the dispenser. An article 9 is wrapped in tear-open sealed wrapper 8. The elongated tab 5 attached to the sealed wrapper on the end of the wrapper opposite the containing the pull-tab 4 at a perforation 10. The free end of the elongated tab—the end not attached to the sealed wrapper—is affixed to the dispenser surface 7 using fastener 6.

The operation of the invention is shown in FIGS. 3-A through 3-E. Article 9 has previously been packaged in tear-open sealed wrapper 8 which is attached at perforation 10 to elongated tab 5, the free end of which is affixed to the dispenser surface 7. When the article 9 is needed, the user grasps pull-tab 4, pulling it from the dispenser. As the tear-open sealed wrapper 8 is pulled from the dispenser, the elongated tab 5 stays affixed to dispenser, causing the wrapper to tear on a sealed edge 12 nearest the pull-tab 4 (FIG. 3A). As the user continues to pull the pull-tab 4 away from the dispenser, the wrapper's seal 12 breaks or tears, freeing the article 9 from the wrapper (FIG. 3-C). The article 9 is exposed or falls free (FIG. 3-D) as the tear-open wrapper 8 breaks from elongated tab 5 along perforation 10 (FIG. 3-E).

Accordingly, the present invention provides a convenient, easy-to-use yet economical method for dispensing and simultaneously unsealing wrapped articles.

Although the present invention described herein contains many specificities, these should not be construed as limiting the scope of the invention but as merely providing illustrations of some of the presently preferred embodiments of this invention. For example, the invention could be housed within furniture or accessories; or, could be used in hotel and dormitory rooms; or, could be shaped differently; or, could be labeled clearly, or color-coded; or, could be used in multiple combinations for different articles; etc.

It is preferred, therefore, that the present invention be limited not only by the specific disclosure herein, but only by the appended claims.

We claim:

1. A dispensing apparatus comprising:

a dispenser having an opening;

a plurality of wrapped articles disposed within said dispenser, each of said wrapped articles having a first and second end;

a pull-tab attached to the first end of each of said wrapped articles; and a plurality of elongated tabs, each of said elongated tabs having opposed ends, one end of each of said elongated tabs being attached to the second end of one of each of said wrapped articles and the other end of each of said elongated tabs being attached to said dispenser, wherein when the pull-tab is pulled outwardly the respective article unwraps and is dispensed through the opening of said dispenser.

2. The dispensing apparatus of claim 1, wherein each of said wrapped articles is wrapped in a wrapper, said pull-tab being attached and extending from one end of the wrapper and the respective elongated tab being attached to another end of the wrapper, the wrapper detaching from the respective elongated tab after the article is dispensed.

3. The dispensing apparatus of claim 2, wherein the wrapper is joined to the respective elongated tab via a perforation.

4. The dispensing apparatus of claim 1, wherein said plurality of wrapped articles are arranged in a fan-like manner within said dispenser, the other end of each of said elongated tabs being attached to said dispenser at the same place on said dispenser.

5. The dispensing apparatus of claim 1, further comprising spring means for pressing said plurality of wrapped articles toward the opening in said dispenser.

6. The dispensing apparatus of claim 5, wherein said spring means is a coil spring.

7. A dispensing apparatus comprising:

a dispenser having an opening;

a plurality of articles disposed within said dispenser;

a wrapper wrapped around each of said articles, each said wrapper having a first and second end;

a pull-tab attached to the first end of each said wrapper; and a plurality of elongated tabs, each of said elongated tabs having opposed ends, one end of each of said elongated tabs being attached to the second end of one of each said wrapper via a perforation and the other end of each of said elongated tabs being attached to said dispenser, wherein when the pull-tab is pulled outwardly, the wrapper and respective elongated tab separate and the respective article unwraps from the wrapper and is dispensed through the opening of said dispenser.

8. A method for dispensing wrapped articles from a dispensing apparatus, comprising the steps of:

locating a plurality of wrapped articles within said dispenser, each of said wrapped articles having a first and second end, the first end of each of said articles including a pull-tab attached thereto, and the second end of each of said articles including an elongated tab attached to said dispenser;

pulling the pull-tab of a respective wrapped article outwardly through an opening in said dispenser; and unwrapping the article as the pull-tab is pulled outwardly through the opening.

* * * * *